US011320133B2

(12) United States Patent
Wang et al.

(10) Patent No.: US 11,320,133 B2
(45) Date of Patent: May 3, 2022

(54) LIGHTING FIXTURE

(71) Applicant: OPPLE LIGHTING CO., LTD., Shanghai (CN)

(72) Inventors: Guoping Wang, Shanghai (CN); Qingjun Wei, Shanghai (CN); Hongbo Wang, Shanghai (CN); Jianzhu Du, Shanghai (CN); Zenglong Zhu, Shanghai (CN)

(73) Assignees: Opple Lighting Co., Ltd., Shanghai (CN); Suzhou Opple Lighting Co., Ltd., Suzhou (CN)

( * ) Notice: Subject to any disclaimer, the term of this patent is extended or adjusted under 35 U.S.C. 154(b) by 0 days.

(21) Appl. No.: 16/693,901

(22) Filed: Nov. 25, 2019

(65) Prior Publication Data

US 2020/0088398 A1 Mar. 19, 2020

Related U.S. Application Data

(63) Continuation of application No. PCT/CN2018/087369, filed on May 17, 2018.

(30) Foreign Application Priority Data

May 25, 2017 (CN) ..... 201720594412.1

(51) Int. Cl.
*F21V 29/76* (2015.01)
*F21S 8/08* (2006.01)
(Continued)

(52) U.S. Cl.
CPC ..... *F21V 29/763* (2015.01); *F21S 8/085* (2013.01); *F21V 17/12* (2013.01); *F21V 31/005* (2013.01);
(Continued)

(58) Field of Classification Search
CPC ..... F21V 29/763; F21V 17/12; F21V 31/005; F21V 29/773; F21V 29/83; F21V 29/75;
(Continued)

(56) References Cited

U.S. PATENT DOCUMENTS 7,758,211 B2 7/2010 Zheng et al.
2008/0285265 A1* 11/2008 Boissevain ..... F21S 8/088 362/218
(Continued)

FOREIGN PATENT DOCUMENTS

CN 2750186 Y 1/2006
CN 101566320 A 10/2009
(Continued)

OTHER PUBLICATIONS

International Search Report to PCT Application No. PCT/CN2018/087369, dated Aug. 9, 2018 with English translation (6p).

*Primary Examiner* — Omar Rojas Cadima
(74) *Attorney, Agent, or Firm* — Arch & Lake LLP

(57) ABSTRACT

A lighting fixture is provided. The lighting fixture includes a lamp body, a light source component and an optical element; the lamp body and the optical element form a closed cavity, the light source component is accommodated in the closed cavity; the light source component includes a light source substrate and a light emitting unit located on a front surface of the light source substrate, and the optical element is located in a light emission direction of the light emitting unit; the light source substrate includes a back surface facing away from the front surface, the lamp body is formed with a heat dissipation structure, and the heat dissipation structure is in contact with the back surface of the light source substrate. The lighting fixture provided by the present disclosure has good heat dissipation performance.

19 Claims, 7 Drawing Sheets

(51) Int. Cl.
*F21V 17/12* (2006.01)
*F21V 31/00* (2006.01)
*F21Y 105/16* (2016.01)
*F21W 111/02* (2006.01)

(52) U.S. Cl.
CPC ..... *F21W 2111/02* (2013.01); *F21Y 2105/16* (2016.08)

(58) Field of Classification Search
CPC ..... F21V 29/76; F21V 29/78; F21S 8/085; F21W 2111/02; F21Y 2115/10; F21Y 2105/10; F21Y 2105/16; F21K 9/00
See application file for complete search history.

(56) References Cited

U.S. PATENT DOCUMENTS

2009/0073681 A1* 3/2009 Chen ..... F21V 29/89 362/218
2009/0257226 A1* 10/2009 Liu ..... F21K 9/66 362/249.02
2011/0038165 A1* 2/2011 Hsu ..... F21V 23/026 362/373
2011/0068708 A1* 3/2011 Coplin ..... F21V 13/04 315/294
2011/0204763 A1 8/2011 Shum et al.
2011/0255273 A1* 10/2011 Lai ..... F21S 8/083 362/183
2012/0218758 A1 8/2012 Wang et al.
2013/0003363 A1 1/2013 Lu et al.
2013/0128589 A1* 5/2013 Kim ..... F21V 29/67 362/294
2014/0049964 A1* 2/2014 McClure ..... B23P 15/26 362/249.06
2014/0071699 A1* 3/2014 Plomteux ..... F21V 17/00 362/373
2014/0307441 A1* 10/2014 Wu ..... F21V 17/12 362/267
2015/0260390 A1* 9/2015 Bretschneider ..... F21V 19/0055 362/294
2016/0047538 A1* 2/2016 Peck ..... F21V 23/009 362/249.02
2018/0208104 A1* 7/2018 Kennemer ..... F21S 41/39

FOREIGN PATENT DOCUMENTS

CN 102116423 A 7/2011
CN 202203729 U 4/2012
CN 102650379 A 8/2012
CN 207146077 U 3/2018

* cited by examiner

LIGHTING FIXTURE

CROSS-REFERENCE TO RELATED APPLICATION

This application is based upon and claims priority to PCT patent application No. PCT/CN2018/087369 filed on May 17, 2018, which claims the priority of Chinese Patent Application No. 201720594412.1 filed on May 25, 2017. The entire contents thereof are incorporated herein by reference.

TECHNICAL FIELD

The present disclosure relates to a lighting technology field, and more particularly, to a lighting fixture with enhanced heat dissipation features.

BACKGROUND

Existing lighting fixtures generally comprise a lamp body, an optical element forming a closed cavity with the lamp body, and a light source component accommodated in the above-described cavity. The optical element is positioned in a light emission direction of the light source component; and light emitted from the light source component passes through the optical element to illuminate a target area. However, heat generated by the light source component when in use can only be transmitted to the lamp body through the air. and heat dissipation efficiency of the light source component is relatively poor. Consequently, excessive heat trapped around the light source component shortens lifetime of the lighting fixture.

SUMMARY

The present disclosure is to provide a lighting fixture with enhanced heat dissipation features, in order to solve the above-described problem.

In a first aspect of the present disclosure, a lighting fixture is provided. The lighting fixture can comprise a lamp body and an optical element forming a closed cavity; a light source disposed in the closed cavity, wherein the light source includes a light source substrate and a light emitting unit located on a front surface of the light source substrate; wherein the optical element is positioned in a light emission direction of the light emitting unit; wherein the light source substrate includes a back surface facing away from the front surface; and wherein the lamp body includes a heat dissipation structure, and the heat dissipation structure is in contact with the back surface of the light source substrate.

BRIEF DESCRIPTION OF THE DRAWINGS

The drawings of the embodiments illustrated herein are to provide further explanations to the present disclosure, and constitute a part of the present disclosure. The exemplary embodiments of the present disclosure and explanations are used to explain the present disclosure and thus are not limitative of the present disclosure.

DETAILED DESCRIPTION

Figure 1:
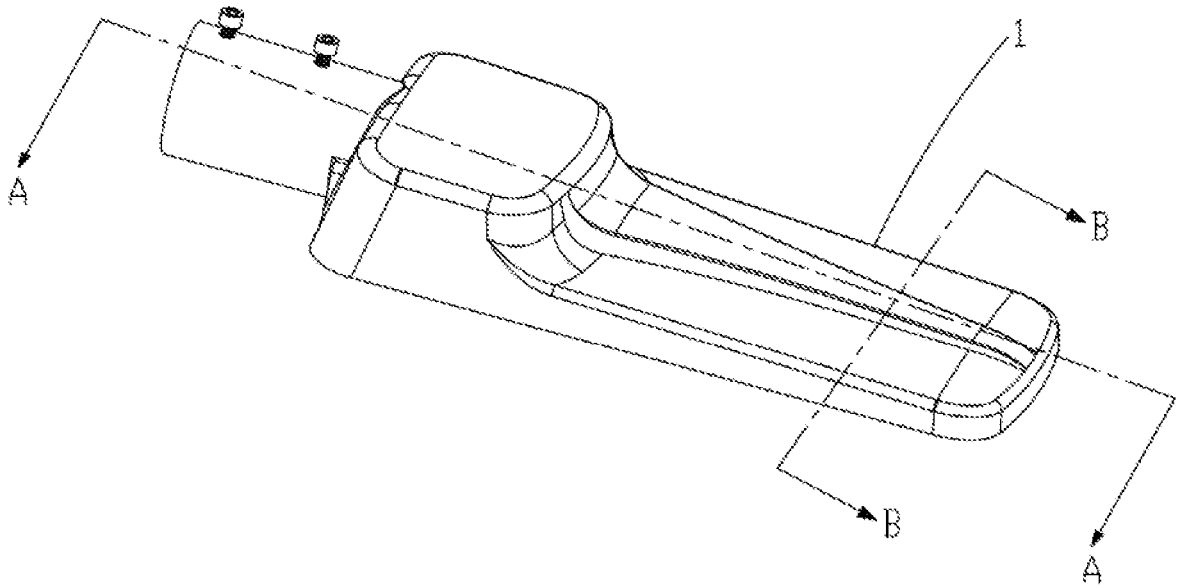
FIG. 1 is a stereoscopic schematic diagram of a lighting fixture according to an exemplary embodiment of the present disclosure.
Figure 2:
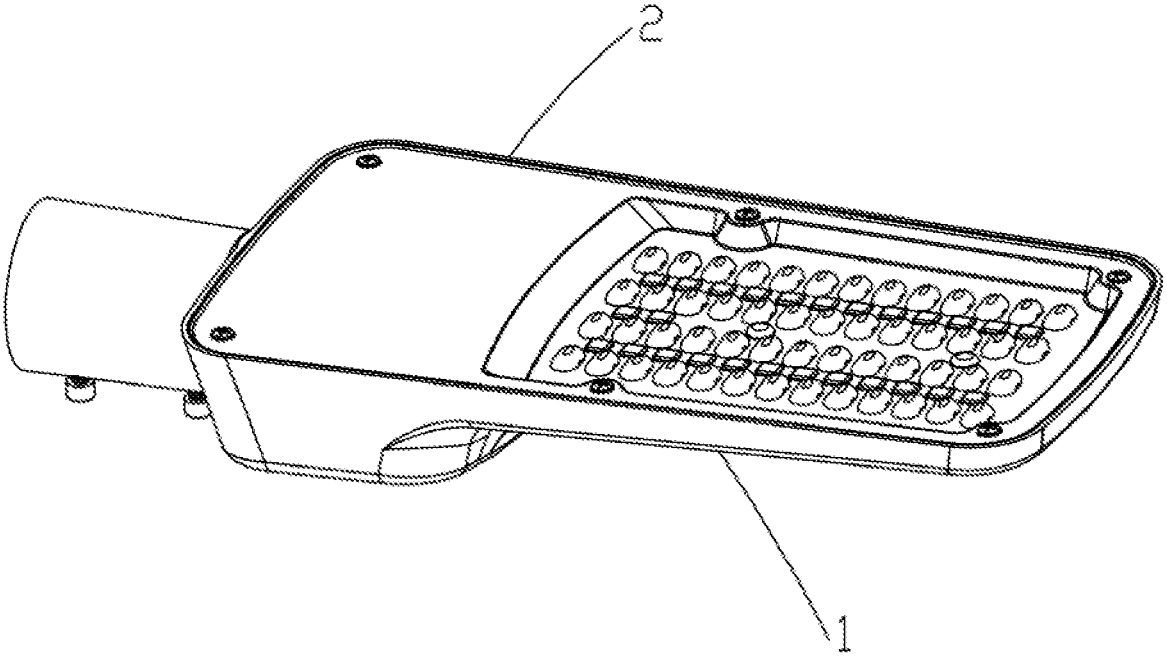
FIG. 2 is a stereoscopic schematic diagram of the lighting fixture of FIG. 1 from another angle.

In order to make objects, technical details and advantages of the embodiments of the present disclosure apparent, the technical solutions of the present disclosure will be described in a clearly and fully understandable way in connection with the embodiments and the corresponding drawings of the present disclosure. It is obvious that the described embodiments are just a part but not all of the embodiments of the present disclosure. Based on the described embodiments herein, those skilled in the art can obtain other embodiment(s), without any inventive work, which should be within the scope of the invention.

As shown in FIG. 1 to FIG. 4, the present disclosure provides a lighting fixture, comprising: a lamp body 1, an optical element 2 connected with the lamp body 1, and a light source component 3 mounted to the lamp body 1. The lamp body 1 and the optical element 2 form a closed cavity (not shown in the drawings), and the light source component 3 is accommodated in the cavity (please refer to FIG. 5). A sealing ring 4 is provided at a connection between the lamp body 1 and the optical element 2. In addition, the lighting fixture according to this embodiment further comprises a connecting component 5, an O-ring 6, a grounding member 7, a ground connecting member 8 and a plastic cable-fastening member 9. Specifically, the lighting fixture provided by this embodiment can be an LED street light.

Below is a detailed description of each element in the present disclosure.

Figure 3:
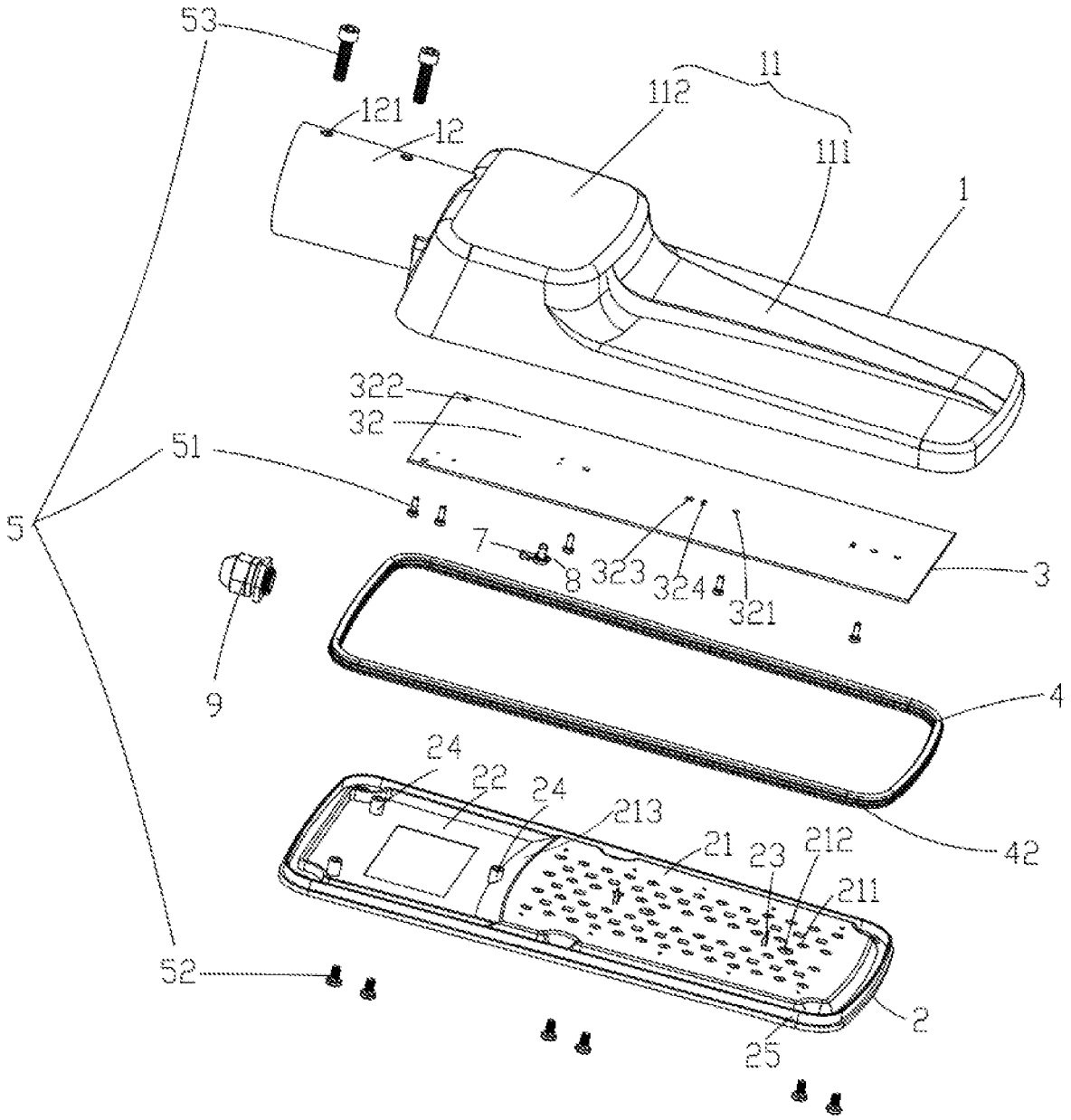
FIG. 3 is a stereoscopic exploded view of the lighting fixture of FIG. 1.

As shown in FIG. 3, the lamp body 1 includes a lamp cover portion 11 and a mounting portion 12.

Figure 4:
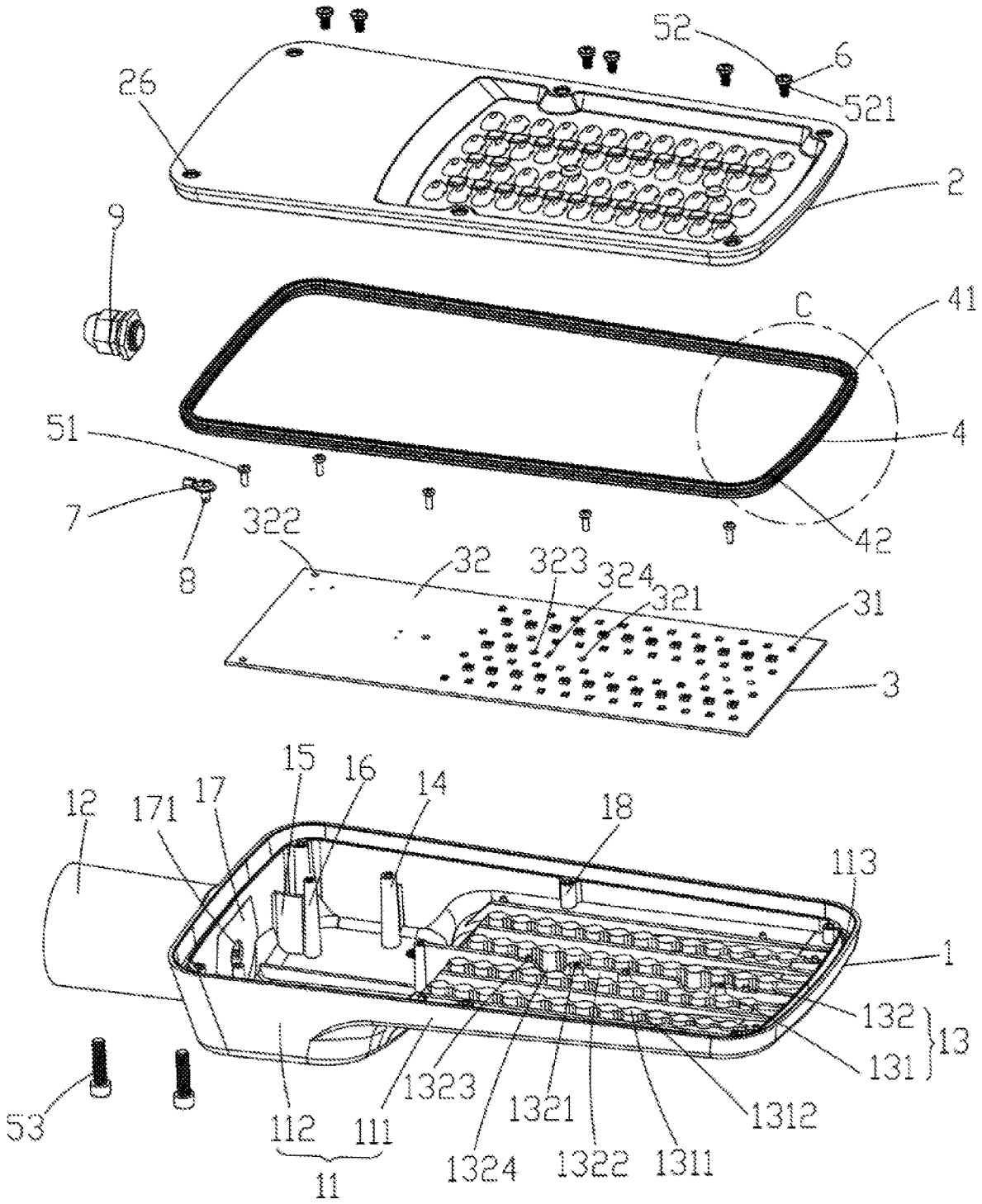
FIG. 4 is a stereoscopic exploded view of the lighting fixture of FIG. 2.

As shown in FIG. 4, the lamp cover portion 11 includes a front cover portion 111 and a rear cover portion 112. An inner surface of the front cover portion 111 extends to form a heat dissipation structure 13. The heat dissipation structure 13 includes four first fin portions 131 and three second fin portions 132; and the first fin portion 131 and the second fin portion 132 are arranged at intervals, possibly with second fin portion in between first fin portions. A first fin portion 131 includes a plurality of fin posts 1311 spaced apart from each other and a first fin 1312 connecting adjacent fin posts 1311. The middle second fin portion 132 includes a plurality of first positioning posts 1321 spaced apart from each other and a second fin 1322 connecting the adjacent first positioning posts 1321. The second fin 1322 further comprises a limit protrusion 1323 and a recessed portion 1324 which do not interfere with each other. The rear cover portion 112 is protruded upwardly with respect to the front cover portion 111 for accommodating elements such as the grounding member 7 and an electrical connector (not shown). An inner surface of the rear cover portion 112 extends to form a hollow second positioning post 14; and the second positioning post 14 works together with the ground connecting member 8 to fix the grounding member 7. The rear cover portion 112 extends inwardly to form a connecting plate 15; and the connecting plate 15 continues to extend to form a hollow third positioning post 16. An edge of the lamp cover portion 11 includes an annular accommodating groove 113; and a groove wall inside the accommodating groove 113 extends to form a plurality of hollow fourth positioning posts 18. Surfaces of the first positioning post 1321 and the third positioning post 16 that face the light source component 3 are on the same level as a surface of the heat dissipation structure 13, so that a contact surface between the lamp body 1 and the light source component 3 is flat.

As shown in FIG. 4, the mounting portion 12 is of a tubular shape; a baffle 17 is formed between the mounting portion 12 and the rear cover portion 112; a first through hole 171 is formed in the baffle 17; and the plastic cable-fastening member 9 may be provided at the first through hole 171, to allow a cable inside the lamp cover portion 11 to extend outside on one hand, and to play a role in sealing and protecting on the other hand. A second through hole 121 is further formed at a top of the mounting portion 12 (please refer to FIG. 3).

As shown in FIG. 3, the optical element 2 is provided opposite to the lamp cover portion 11, and is connected with the lamp cover portion 11. The optical element 2 is provided with a front hood portion 21 with respect to the front cover portion 111; and a plurality of light source grooves 211 and an accommodating groove 212 spaced apart from each other are formed on an inner surface of the front hood portion 21. The optical element 2 according to this embodiment is a lens hood, and the light source groove 211 is a lens groove. At a same time, the inner surface of the front hood portion 21 further extends to form a fixture block 23; a top of the fixture block 23 is a wedge-shaped block and a bottom of the fixture block 23 is a square block, the fixture block 23 is of a hook shape with a certain angle between the top and the bottom. The optical element 2 is provided with a rear hood portion 22 with respect to the rear cover portion 112. An inclined surface 213 is formed in the front hood portion 21 at a position close to the rear hood portion 22; and inner surfaces of the rear hood portion 22 and the inclined surface 213 extend to form a hollow support post 24 for supporting the light source component 3 above; in addition, a surface on a side of the support post 24 that faces the light source component 3 is the same as the front hood portion 21 in height, so that a contact surface between the optical element 2 and the light source component 3 is a plane. An edge of the optical element 2 forms a ring of annular convex rib 25 along a direction toward the lamp body 1. At a same time, referring to FIG. 4, the optical element 2 is further formed with a fourth positioning hole 26 with respect to the fourth positioning post 18. A connecting member may be inserted into the fourth positioning post 18 through the fourth positioning hole 26, to connect the lamp body 1 with the optical element 2.

As shown in FIG. 4, the light source component 3 includes a light emitting unit 31 and a light source substrate 32 electrically connected with the light emitting unit 31. The light source substrate 32 has a front surface and a back surface that face away from each other. A side of the light emitting unit 31 that faces away from the optical element 2 is soldered to the front surface of the light source substrate 32, that is, the light emitting unit 31 is located on the front surface of the light source substrate 32, and the optical element 2 is located in a light emission direction of the light emitting unit 31. At a same time, the heat dissipation structure 13 formed by the lamp body 1 is in contact with the back surface of the light source substrate 32. Specifically, both the fin post 1311 and the first fin 1312 of the first fin portion 131 are in contact with the back surface of the light source substrate 32, and each fin post 1311 is aligned with one light emitting unit 31; the second fin portion 132 is also in contact with the back surface of the light source substrate 32, and is staggered from the light emitting unit 31. In this embodiment, heat generated by the light source component 3 is thermally conducted to the lamp cover portion 11 through the heat dissipation structure 13, and then released to an external environment through the lamp cover portion 11, so that heat of the street light is effectively dissipated without affecting sealing property of the street light cavity.

Figure 6:
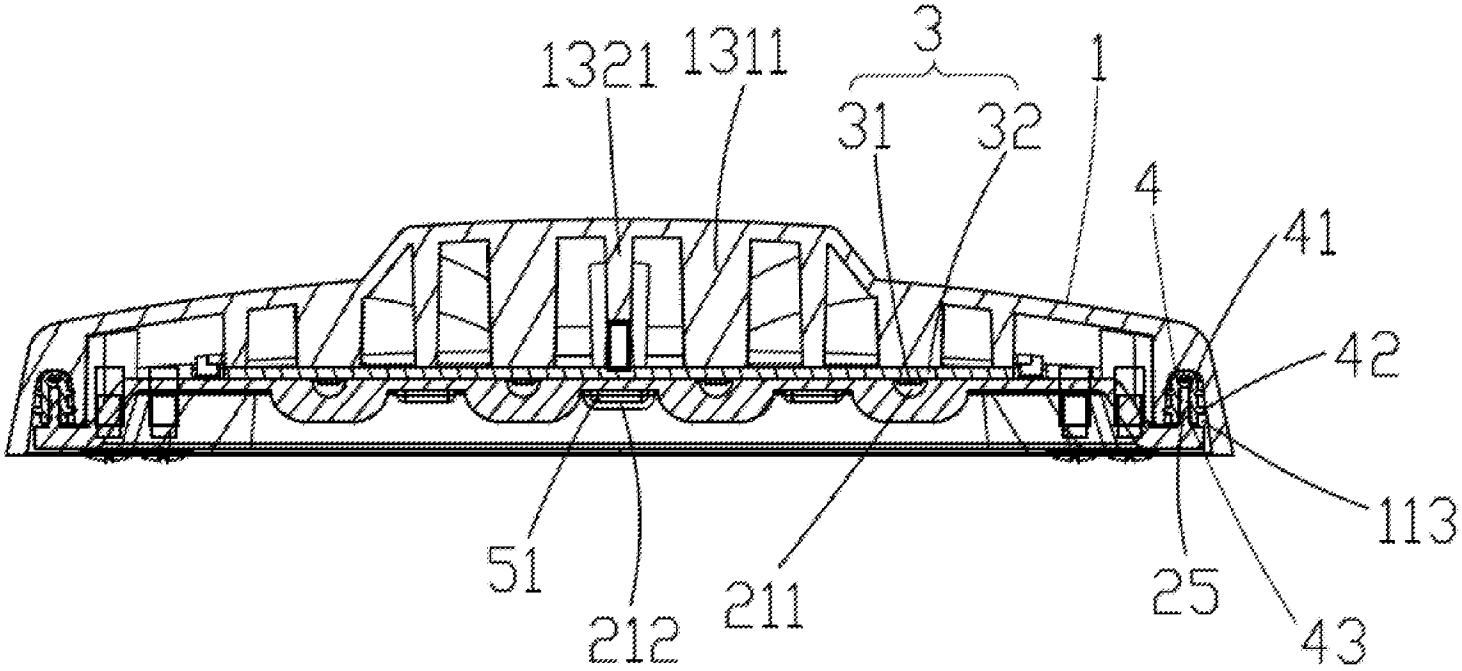
FIG. 6 is a cross-sectional view taken along a B-B direction in FIG. 1.

As shown in FIG. 6, the light emitting unit 31 is accommodated in the light source groove 211 of the optical element 2; the light source groove 211 is a lens groove; and light emitted from the light emitting unit 31 is distributed and adjusted by the light source groove 211 to be emitted. The light emitting unit 31 serves as a working element, and is a main heat-generating element of the light source component 3. In this embodiment, the heat dissipation structure 13 of the lighting fixture is arranged according to distribution of heat generated by the light source component 3, so that heat may be dissipated more uniformly and effectively. Specifically, firstly, a position of a light emitting unit 31 soldered on the light source substrate corresponds to a position of a fin post 1311 of a first fin portion 131 in a one-to-one corresponding relationship, so that heat generated by the light emitting unit 31 may be released timely, and a cross-sectional area of the fin post 1311 is larger than a cross-sectional area of the light emitting unit 31, which further enhances a heat dissipation effect; secondly, a first fin 1312 connects adjacent fin posts 1311, to assist the fin posts 1311 to dissipate heat; thirdly, the second fin portions 132 and the first fin portions 131 are arranged to space apart from each other, to assist the first fin portion 131 to dissipate heat. Of course, in other embodiment of the present disclosure, a heat dissipation structure 13 may also be arranged in other manner, for example, there is only one of a first fin portion 131 and a second fin portion 132, or the first fin portion 131 has only a fin post 1311, and so on.

As shown in FIG. 4, a first positioning hole 321 is formed in the light source substrate 32 with respect to the first positioning post 1321 of the middle second fin portion 132, and a connecting member may be inserted into the first positioning post 1321 through the first positioning hole 321, to connect the light source component 3 with the second fin portion 132, so that the second fin portion 132 not only has a heat dissipation function, but also can assemble the light source component 3 and the lamp body 1 together. A third positioning hole 322 is formed in the light source substrate 32 with respect to the third positioning post 16 of the rear cover portion 112, and a connecting member may be inserted into the third positioning post 16 through the third positioning hole 322 to strengthen fixity of connection between the light source substrate 32 and the lamp body 1. A limit hole 323 is further formed in the light source substrate 32 with respect to the limit protrusion 1323 of the middle second fin portion 132, and the limit protrusion 1323 is inserted into the limit hole 323 when the light source component 3 is assembled with the lamp body 1, to implement precise alignment of the light source component 3 with the lamp body 1. At a same time, a fixture hole 324 is formed in the light source substrate 32 with respect to the fixture block 23 of the optical element 2 (please refer to FIG. 3), and the fixture block 23 passes through the fixture hole 324, to implement precise alignment of the light source component 3 with the optical element 2, and at a same time, fix the light source component 3 with the optical element 2 together. After the fixture block 23 passes through the fixture hole 324, the wedge-shaped block at the top is accommodated in the recessed portion 1324 of the middle second fin portion 132 of the lamp body 1.

Figure 7:
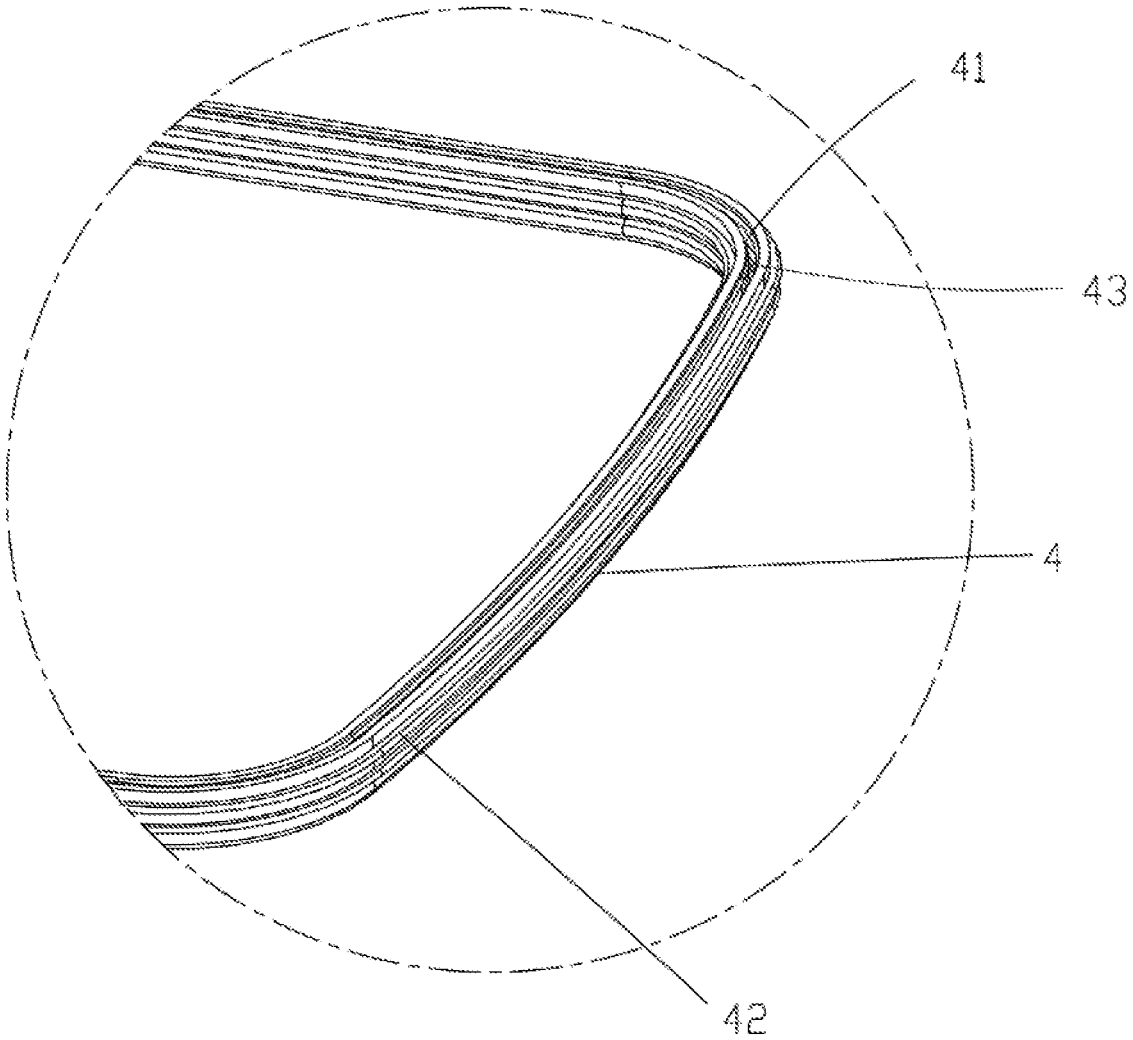
FIG. 7 is an enlarged perspective view of a sealing ring of the lighting fixture as shown in region C of FIG. 4.

As shown in FIG. 4 and FIG. 7, the sealing ring 4 has a groove 41 on a side facing the optical element 2. Referring to FIG. 6, the annular convex rib 25 of the optical element 2 is inserted into the groove 41, that is, the edge of the optical element 2 is inserted into the groove 41. The sealing ring 4 is inserted into the accommodating groove 113 of the lamp body 1. The sealing ring 4 is further formed with two pairs of first annular protrusions 42 and two pairs of second annular protrusions 43; the first annular protrusion 42 extends toward an inner wall of the accommodating groove 113 and abuts against the inner wall of the accommodating groove 113; the second annular protrusion 43 is located on an inner wall of the groove 41, and the second annular protrusion 43 extends toward the annular convex rib 25 of the optical element 2 and abuts against the annular convex rib 25, so that the lamp body 1 and the optical element 2 are connected with each other more closely, to enhance sealing property of the cavity formed by the lamp body 1 and the optical element 2. Of course, in other embodiment of the present disclosure, an edge of an optical element 2 may also be directly inserted into a groove 41 without forming an annular convex rib 25, and a second annular protrusion 43 may also directly extend toward the edge of the optical element 2 and abut against the edge of the optical element 2.

Figure 5:
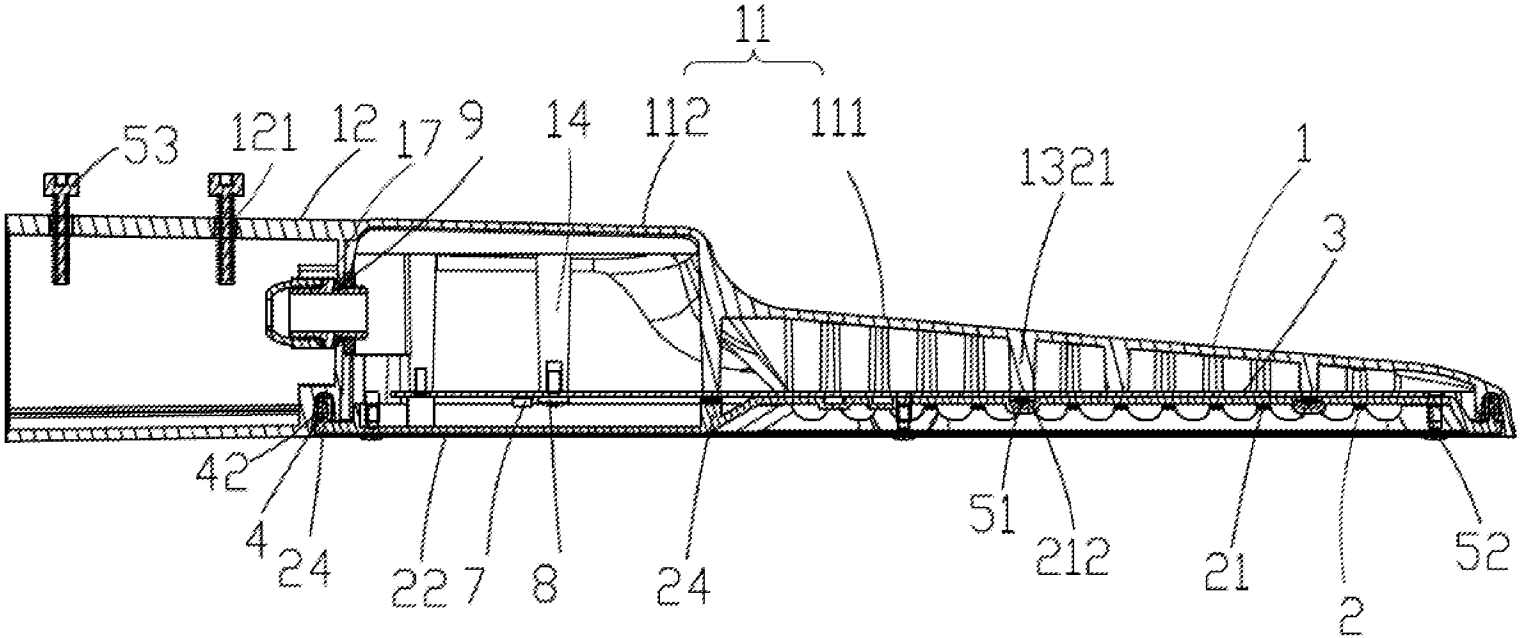
FIG. 5 is a cross-sectional view taken along an A-A direction in FIG. 1.

As shown in FIG. 3, the connecting component 5 includes a first connecting member 51, a second connecting member 52 and a third connecting member 53. Referring to FIG. 5, in this embodiment, the first connecting member 51, the second connecting member 52 and the third connecting member 53 are all screws. The first connecting members 51 are inserted into the first positioning post 1321 and the third positioning post 16 of the lamp body 1 through the first positioning hole 321 and the third positioning hole 322 of the light source component 3, to assemble the light source substrate 32 and the lamp cover portion 11 together. Thus, the first positioning post 1321 and the light source substrate 32 are connected with each other by the first connecting member 51. Heads of the screws passing through the third positioning hole 322 and the first positioning hole 321 correspondingly fall into the support post 24 and the accommodating groove 212, to ensure flatness of a contact surface between the optical element 2 and the light source substrate 32. At a same time, the screw is made of a metal material, and has good thermal conductivity, which is favorable for heat on the light source substrate 32 to be conducted to the first positioning post 1321, then conducted to the lamp cover portion 11 through the first positioning post 1321, and finally released into the surrounding environment through the lamp cover portion 11. The second connecting member 52 is inserted into the fourth positioning post 18 of the lamp body 1 through the fourth positioning hole 26 of the optical element 2, to connect the lamp body 1 with the optical element 2, that is, the lamp body 1 and the optical element 2 are connected with each other by the second connecting member 52. The third connecting member 53 is inserted into the second through hole 121 of the mounting portion 12, so that the lighting fixture can be mounted at a work place (not shown).

Figure 8:
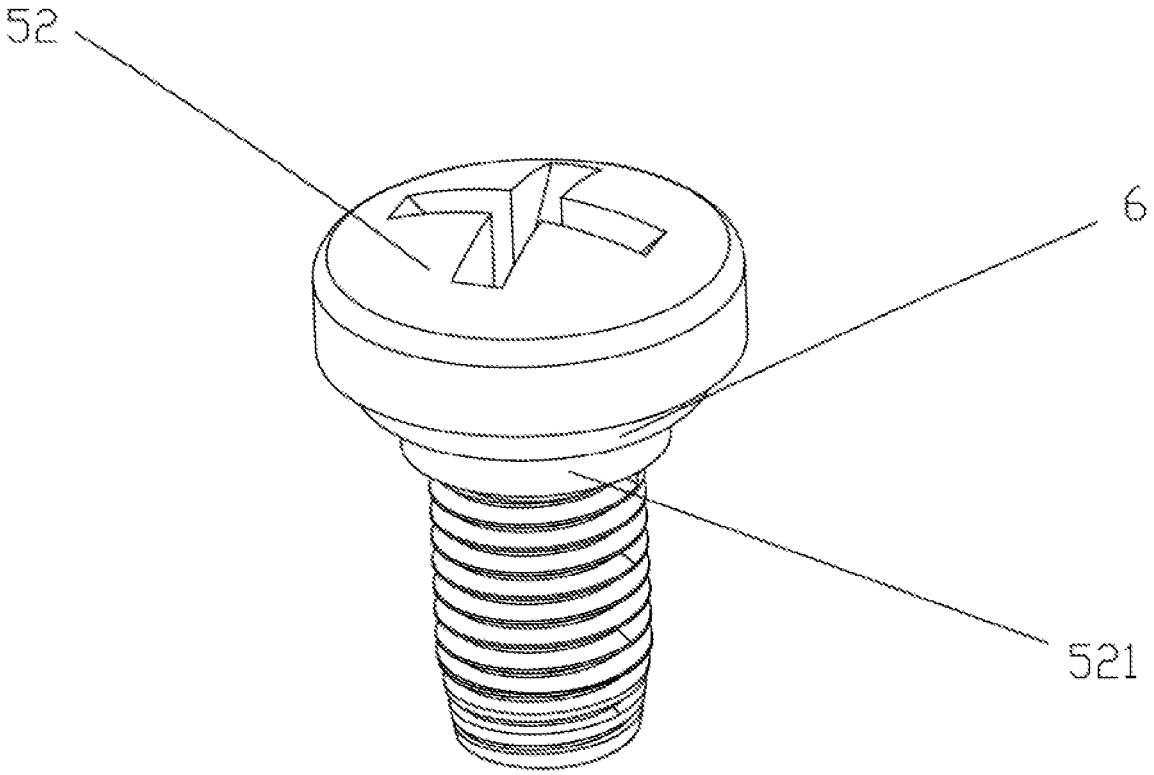
FIG. 8 is an enlarged stereoscopic view of part of a second connecting member of the lighting fixture of FIG. 4.

As shown in FIG. 8, the O-ring 6 is provided between the optical element 2 and the second connecting member 52; specifically, a step 521 is formed below a head of the second connecting member 52, the O-ring 6 is sleeved on an outer surface of the step 521 of the second connecting member 52; a step (not shown) is also formed in the fourth positioning hole 26 of the optical element 2; when the second connecting member 52 connects the lamp body 1 with the optical element 2, the O-ring 6 on the outer surface of the step 521 of the second connecting member 52 is clamped on the step of the fourth positioning hole 26 of the optical element 2, and is in contact with a hole wall of the fourth positioning hole 26; and the O-ring 6 prevents rain or the like from passing through the second connecting member 52 to enter the cavity formed by the lamp cover portion 1 and the optical element 2, and enhances sealing property of the lighting fixture. Of course, in other embodiment of the present disclosure, a step 521 may not be formed, or an O-ring 6 may also be provided away from a head of a second connecting member 52.

As shown in FIG. 5, the grounding member 7 is provided in a cavity formed by the lamp cover portion 11 and the optical element 2, and is electrically connected with a ground cable (not shown), to bring static electricity into the ground and release the same, once leakage of electricity occurs to the lighting fixture, and to prevent an electric shock accident. A second positioning hole 71 is formed in the grounding member.

As shown in FIG. 5, the ground connecting member 8 is inserted into the second positioning post 14 through the second positioning hole (not shown) of the grounding member 7, to fix the grounding member 7.

As shown in FIG. 5, the plastic cable-fastening member 9 is provided at the baffle 17, to lead out the cable inside the lamp cover portion 11 on the one hand, and play a role in sealing and protecting on the other hand.

In summary, the lighting fixture comprises the lamp body 1, the heat dissipation structure 13 is formed on the inner surface of the lamp body 1, and the light source component 3 is in contact with the heat dissipation structure 13. Heat generated by the light source component 3 can be thermally conducted to the lamp body 1 through the heat dissipation structure 13, and then released to the external environment through the lamp body 1, so as to effectively dissipate heat from the lighting fixture.

For example, the heat dissipation structure includes at least one first fin portion; wherein the first fin portion includes a plurality of fin posts spaced apart from each other; and the fin posts are in contact with the back surface of the light source substrate and are aligned with the light emitting unit.

For example, the first fin portion further includes at least one first fin; adjacent fin posts are connected by the first fin; and the first fin is in contact with the back surface of the light source substrate.

For example, a cross-sectional area of the fin post is larger than a cross-sectional area of the light emitting unit.

For example, the heat dissipation structure further includes at least one second fin portion; and the second fin portion is in contact with the back surface of the light source substrate and is away from the light emitting unit.

For example, the second fin portion and the first fin portion are arranged at intervals.

For example, one of the second fin portions includes a plurality of first positioning posts spaced apart from each other; the lighting fixture further comprises a first connecting member; and the first positioning post and the light source substrate are connected with each other by the first connecting member.

For example, the second fin portion further includes a second fin connecting adjacent first positioning posts.

For example, the lighting fixture further comprises a sealing ring; and the sealing ring is provided at a connection between the lamp body and the optical element.

For example, the lamp body includes an accommodating groove that is annular; the sealing ring is inserted into the accommodating groove; the sealing ring comprises a groove; and an edge of the optical element is inserted into the groove.

For example, the sealing ring further comprises a first annular protrusion; and the first annular protrusion extends toward an inner wall of the accommodating groove and abuts against the inner wall of the accommodating groove.

For example, the sealing ring further comprises a second annular protrusion; the second annular protrusion is located on an inner wall of the groove; and the second annular protrusion extends toward the edge of the optical element and abuts against the edge of the optical element.

For example, the lighting fixture further comprises a second connecting member; the lamp body and the optical element are connected with each other by the second connecting member; and an O-ring is provided between the optical element and the second connecting member.

For example, the lighting fixture is a street light.

In contrast to the prior art, the lighting fixture in the present disclosure comprises a lamp body. The lamp body includes a heat dissipation structure. The heat dissipation structure is in contact with a back surface of a light source substrate. Heat generated by the light source component can be transmitted to the lamp body through the heat dissipation structure. and then released from the lamp body to an external environment, to effectively dissipate heat from the lighting fixture.

The specific embodiments of the present disclosure described above explain in detail objects, technical details and advantages of the embodiments of the present disclosure. It should be understood that what are described above is related to the specific embodiments of the disclosure only and not limitative to the scope of the disclosure. Any modification and equivalent replacement which is made within the spirit and principle of the embodiments of the present disclosure is regarded as falling within the protection scope of embodiments of the present disclosure.

The invention claimed is:

1. A lighting fixture, comprising:

a lamp body and an optical element forming a closed cavity;

a light source disposed in the closed cavity, wherein the light source includes a light source substrate and a light emitting unit located on a front surface of the light source substrate;

wherein the optical element is positioned in a light emission direction of the light emitting unit;

wherein the light source substrate includes a back surface facing away from the front surface; and wherein the lamp body includes a heat dissipation structure, the heat dissipation structure is in contact with the back surface of the light source substrate, the heat dissipation structure comprises a plurality of first fins and second fins, the second fins are disposed parallelly in between the plurality of first fins, the second fins are in contact with the back surface of the light source substrate, and are staggered from the light emitting unit, adjacent two first fins are spaced apart by one second fin, adjacent two second fins are spaced apart by one first fin, and both the plurality of first fins and the second fins are in direct contact with the back surface of the light source substrate.

2. The lighting fixture according to claim 1, wherein the heat dissipation structure includes at least one first fin of the plurality of first fins; the first fin includes a plurality of fin posts spaced apart from each other; and the plurality of fin posts are in contact with the back surface of the light source substrate and are aligned with the light emitting unit.

3. The lighting fixture according to claim 2, wherein the first fin further includes a third fin; the third fin connects the plurality of fin posts that are adjacent; and the third fin is in contact with the back surface of the light source substrate.

4. The lighting fixture according to claim 2, wherein a cross-sectional area of the plurality of fin post is larger than a cross-sectional area of the light emitting unit.

5. The lighting fixture according to claim 1, wherein the second fin and the first fin are arranged at intervals.

6. The lighting fixture according to claim 1, wherein one of the second fin includes a plurality of first positioning posts spaced apart from each other; the lighting fixture further comprises a first connecting member; and the plurality of first positioning posts and the light source substrate are connected with each other by the first connecting member.

7. The lighting fixture according to claim 6, wherein the plurality of first fins further include a third fin, and wherein the second fin further includes a fourth fin connecting the plurality of first positioning posts that are adjacent.

8. The lighting fixture according to claim 6, wherein the lighting fixture further comprises a second connecting member; the lamp body and the optical element are connected with each other by the second connecting member; and an O-ring is provided at a connection between the optical element and the second connecting member.

9. The lighting fixture according to claim 1, wherein the lighting fixture further comprises a sealing ring; and the sealing ring is positioned at a connection between the lamp body and the optical element.

10. The lighting fixture according to claim 9, wherein the lamp body includes an accommodating groove that is annular; the sealing ring is inserted into the accommodating groove; the sealing ring includes a groove; and an edge of the optical element is inserted into the groove of the sealing ring.

11. The lighting fixture according to claim 10, wherein the sealing ring further comprises a first annular protrusion; and the first annular protrusion extends toward an inner wall of the accommodating groove and abuts against the inner wall of the accommodating groove.

12. The lighting fixture according to claim 10, wherein the sealing ring further comprises a second annular protrusion; the second annular protrusion is located on an inner wall of the groove; and the second annular protrusion extends toward the edge of the optical element and abuts against the edge of the optical element.

13. The lighting fixture according to claim 1, wherein the lighting fixture is a street light.

14. A lamp body, comprising:

a lamp cover that includes a front cover and a rear cover;

a mounting portion, wherein a baffle is attached between the mounting portion and the rear cover; and a heat dissipation structure that includes a plurality of first fins and second fins, wherein the second fins are disposed parallelly in between the plurality of first fins, the second fins are in contact with a back surface of a light source substrate, and are staggered from the light emitting unit, adjacent two first fins are spaced apart by one second fin, adjacent two second fins are spaced apart by one first fin, and both the plurality of first fins and the second fins are in direct contact with the back surface of the light source substrate.

15. The lamp body according to claim 14, wherein the second fin and the plurality of first fins are arranged at intervals.

16. The lamp body according to claim 14, wherein the plurality of first fins include a plurality of fin posts spaced apart from each other, and a third fin that connects the plurality of fin posts that are adjacent.

17. The lamp body according to claim 14, wherein the plurality of first fins further include a third fin, and wherein the second fin includes a plurality of first positioning posts spaced apart from each other, and a fourth fin connecting the plurality of first positioning posts that are adjacent.

18. The lamp body according to claim 14, wherein the second fin includes a limit protrusion and a recessed portion that are space apart from each other.

19. The lamp body according to claim 14, wherein the lamp body further comprises an accommodating groove that is annular.

* * * * *